United States Patent [19]

Bell

[11] Patent Number: 4,978,997

[45] Date of Patent: Dec. 18, 1990

[54] CROSSMIXING DUAL AUGER SYSTEM

[75] Inventor: Conrad J. Bell, Webster, N.Y.

[73] Assignee: Xerox Corporation, Stamford, Conn.

[21] Appl. No.: 360,809

[22] Filed: Jun. 2, 1989

[51] Int. Cl.[5] ..... G03G 15/09

[52] U.S. Cl. ..... 355/253; 355/251; 118/657

[58] Field of Search ..... 355/253, 251, 245; 118/657, 658; 222/DIG. 1; 366/86, 84, 15

[56] References Cited

U.S. PATENT DOCUMENTS

| | | | |
|---|---|---|---|
| 2,028,745 | 1/1936 | Hendrick et al. | 366/15 |
| 3,664,299 | 5/1972 | Shaler et al. | 118/637 |
| 3,999,514 | 12/1976 | Abbott et al. | 118/657 |
| 4,056,076 | 11/1977 | Smith | 118/653 |
| 4,146,323 | 3/1979 | Forward et al. | 355/3 DD |
| 4,274,362 | 6/1981 | Beck et al. | 118/657 |
| 4,478,512 | 10/1984 | Zoltner | 355/3 DD |
| 4,576,466 | 3/1986 | Fukuchi et al. | 355/253 |

*Primary Examiner*—A. T. Grimley
*Assistant Examiner*—Sandra L. Hoffman

[57] ABSTRACT

A development system for a reproduction machine includes a pair of augers which mix and transfer the developer mixture to a magnetic roll brush system. The supply auger is positioned in a horizontal plane; the second return auger is at an angle to the first auger. The first auger transports developer material in one direction mixing the developer material and dispensing developer material along its length by gravity to the magnetic brush roll sump. A developer material transport opening at one end allows developer material to be gravity fed to the adjacent end of the inclined auger which carries the developer material uphill. The developer material is transferred at the other end by gravity feed back to the first auger.

6 Claims, 4 Drawing Sheets

CROSSMIXING DUAL AUGER SYSTEM

BACKGROUND AND INFORMATION DISCLOSURE STATEMENT

The invention relates generally to an electrophotographic printing machine and, more particularly, to a development system which includes a dual auger assembly for mixing the developer.

Generally, an electrophotographic printing machine includes a photoconductive member which is charged to a substantially uniform potential to sensitive the surface thereof. The charged portion of the photoconductive member is exposed to a light image of an original document being reproduced. This records an electrostatic latent image on the photoconductive member corresponding to the informational areas contained within the original document. After the electrostatic latent image is formed on the photoconductive member, the image is developed by bringing a developer material into contact therewith. Generally, the developer material comprises toner particles adhering triboelectrically to carrier granules. The toner particles are attached to the latent image from the carrier granules to form a powder image on the photoconductive member which is subsequently transferred to a copy sheet. Finally, the copy sheet is heated to permanently affix the powder image thereto in image configuration.

As the toner particles are depleted from the developer material, it is necessary to dispense additional toner particles into the developer mixture. Then newly added toner is typically mixed in some manner with the denuded carrier particles and unused developer material. Various prior art devices have been devised to accomplish the mixing function. A preferred system for accomplishing the crossmixing function is the use of a dual auger system to transport the toner in two directions and achieve a toner interchange between augers. Dual auger systems are disclosed, for example, in the following prior art documents. U.S. Pat. No. 4,274,362 to Beck et al discloses magnetic brush mixing augers made of twisted strips of aluminum sheet metal with smooth axial edges. In a developing unit, the auger members are located in the sump portion of a developing pan where they circulate, distribute and intermix dry toner. A dispensing system evenly distributes regular amounts of toner while the copier is operable.

U.S. Pat. No. 4,056,076 to Smith, assigned to Xerox Corporation, discloses a crossmixing system for mixing and charging multicomponent developer in a circulating development system of an electrostatographic processor. A pair of parallel passive crossmixers are used as mixing devices and a single active crossmixer is used as a blending (triboelectric charging) device.

U.S. Pat. No. 4,146,323 to Forward et al, assigned to Xerox Corporation, discloses an auger for a development system comprised of an elongated twisted strip of sheet metal with helically contoured edges. As toner is dispensed, fresh toner is added to the developer from a toner dispenser directly above a crossmixer to keep the toner concentration at a high level.

U.S. Pat. No. 4,478,512 to Zoltner, assinged to Xerox Corporation, discloses a developer system in which a pair of augers mix newly dispensed toner with denuded carrier particles and returns the mixture into a developer sump.

U.S. Pat. No. 3,999,514 to Abbott et al describes a supply and return auger system in which the augers are rotated at different flute and pitch related speeds which ensure equal flow through the auger.

U.S. Pat. No. 3,664,299 to Shaler et al discloses still another dual auger mixing system.

These prior art patents described above are representative of the dual auger crossmixing type of system. The common characteristic of these systems is that the axis of each auger pair lie essentially in the same horizontal plane with developer exchange between each auger taking place at end locations. A problem with this inter-auger trasnfer is that the developer is exchanged by a sideways pushing application which requires that the augers be physically close to each other. For some systems, this proximity requirement may present a space or geometry problem. A second difficulty with this "push" inter-auger transfer is the tendency for the developer to "bunch up" at the transfer end, sometimes resulting in toner spilling over into other areas of the developer housing unless specific seals are placed at strategic locations.

The present invention is, therefore, directed to a dual auger crossmixing system which accomplishes inter-auger developer transfer by a construction which utilizes the forces of gravity to accomplish the transfer at each auger end. By allowing the force of gravity to act on the developer as it exits an auger end, and in combination with appropriate side baffles to direct developer travel, the auger can be spaced physically further apart than is possible with the prior art systems. Because of the "drop distance" between each auger end, no developer buildup is experienced at either end. More particularly, the invention is directed toward a development system including a developer roll adapted for depositing developer material on an imaging surface having an electrostatic latent image thereon, a dual auger system for mixing said developer material and transferring mixed developer material to said developer roll, said dual auger system comprising a first auger aligned in a horizontal plane and adapted to mix and supply developer material to said developer roll, a second auger, adjacent to said first auger and positioned along a non-horizontal plane so that adjacent ends of said first and second auger are separated by a vertical distance, said augers having a plurality of developer material transport communication apertures at said auger ends whereby developer material is transported from one auger to the other by gravitational forces.

DESCRIPTION OF THE INVENTION

Figure 1:
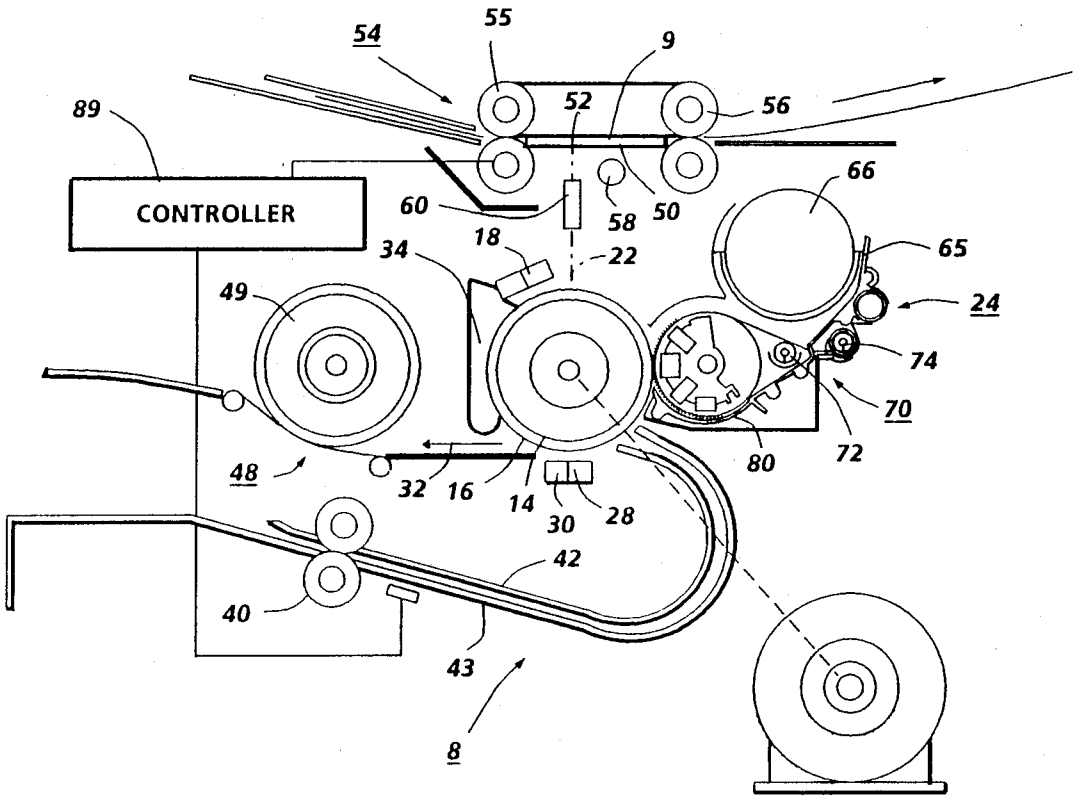
FIG. 1 is a side view, is section, of a xerographic reproduction machine incoporating the dual auger mixing assembly of the present invention.

Referring to FIG. 1 of the drawings, there is shown a xerographic type reproduction machine 8 incorporating the dual auger mixing assembly of the present invention, designated generally by the numeral 10. Machine 8 has a suitable frame (not shown) on which the machine xerographic components are operatively supported. Briefly, and as will be familiar to those skilled in the art, the machine xerographic components include a recording member, shown here in the form of a rotatable photoreceptor 14. In the exemplary arrangement shown, photoreceptor 14 comprises a drum having a photoconductive surface 16. Operatively disposed about the periphery of photoreceptor 14 are a charge corotron 18 for placing a uniform charge on the photoconductive surface 16 of photoreceptor 14; an exposure station 22 where the previously charged photoconductive surface 16 is exposed to image rays of a document 9 being copied or reproduced; development station 24 where the latent electrostatic image created on photoconductive surface 16 is developed by toner; and transfer detack corotrons 28 and 30 for assisting transfer of the developed image to a suitable copy substrate material such as a copy sheet 32 brought forward in timed relation with the developed image on photoconductive surface 16. Residual toner is removed from the drum surface at cleaning station 34.

Copy sheets 32 are brought forware to the transfer area by feed roll pair 40, sheet guides 42, 43 serving to guide the sheet through an approximately 180° turn prior to the transfer area. Following transfer, the sheet 32 is carried forward to a fusing station 48 where the toner image is fixed by fusing roll 49. After fusing, the copy sheet 32 is discharged to an output tray.

A transparent platen 50 supports the document 9 as the document is moved past a scan point 52 by a constant velocity type transport 54. As will be understood, scan point 52 is in effect a scan line extending across the width of platen 50 at a desired point along the platen where the document is scanned line by line as the document is moved along platen 50 by transport 54. Transport 54 has input and output document feed roll pairs 55, 56, respectively, on each side of scan point 52 for moving document 9 across platen 50 at a predetermined speed. Exposure lamp 58 is provided to illuminate a strip-like area of platen 50 at scan point 52. The image rays from the document line scanned are transmitted by a gradient index fiber lens array 60 to exposure station 22 to expose the photoconductive surface 16 of the moving photoreceptor 14.

Developer station 24 includes a developer housing 65 in which a toner dispensing cartridge 66 is rotatably mounted so as to dispense toner particles downward into a sump area occupied by the dual auger mixing assembly 70 of the present invention. Assembly 70 includes a pair of rotatably mounted augers 72, 74; further details of the construction and operation of assembly 70 are provided below.

Continuing with the description of the developing station 24, a magnetic brush developer roll 80 is disposed in predetermined operative relation to the photoconductive surface 16 of photoreceptor 14, the length of developing roll 80 being equal to or slightly greater than the width of photoconductive surface 16, with the axis of roll 80 parallel to the axis of photoreceptor 14. Developer roll 80 has a plurality of stationary magnet assemblies 81 (FIG. 2) disposed within a rotatable cylinder or sleeve 75, sleeve 75 being rotatably journaled for rotation in the opposing sides of developer housing 65. Magnet assemblies 81 are arranged so that as sleeve 75 rotates, developer is attracted to the exterior surface of sleeve 75 to form a brush-like layer 82 on sleeve 75. Rotation of sleeve 75 carries the developer brush 82 into developing relation with the photoconductive surface 16 of photoreceptor 14 to develop the latent electrostatic image therein.

Figure 2:
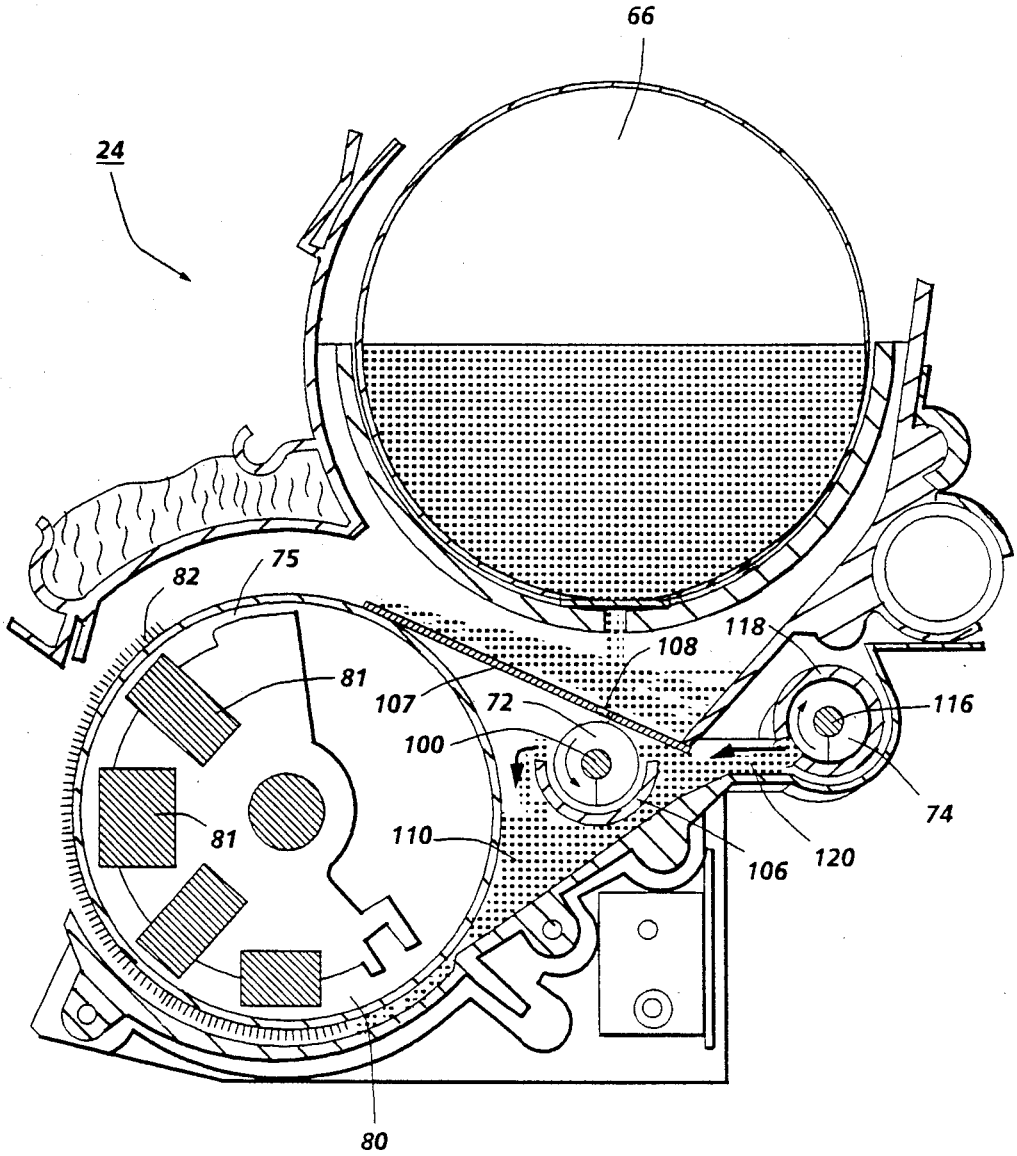
FIG. 2 is an enlarged side view of the developer assembly shown in FIG. 1.
Figure 3:
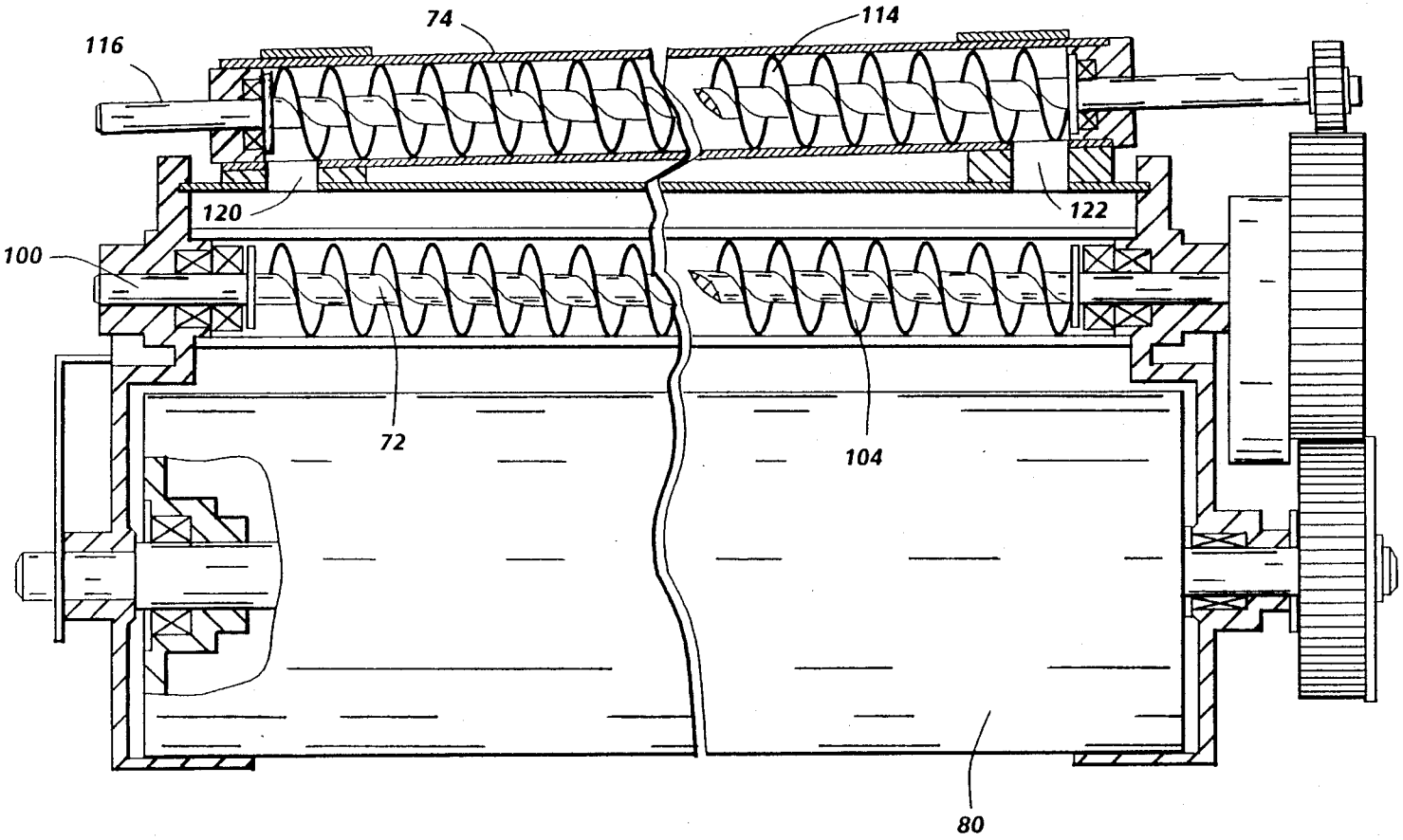
FIG. 3 is a top alternate side view of the developer assembly shown in FIG. 1.
Figure 4:
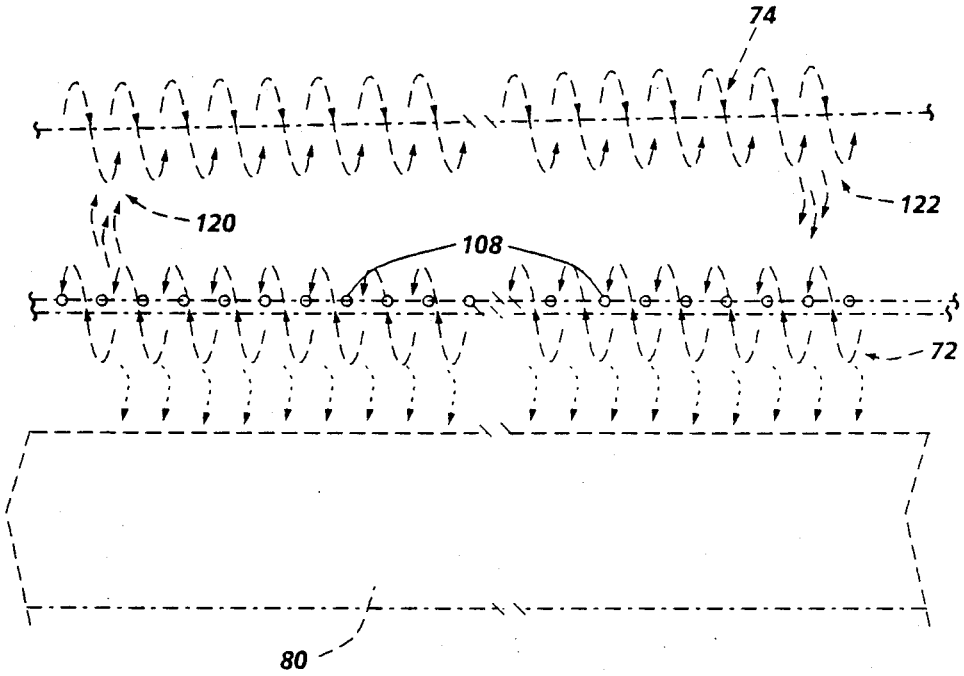
FIG. 4 is top view schematic representation of the developer material transfer between augers.
Figure 5:
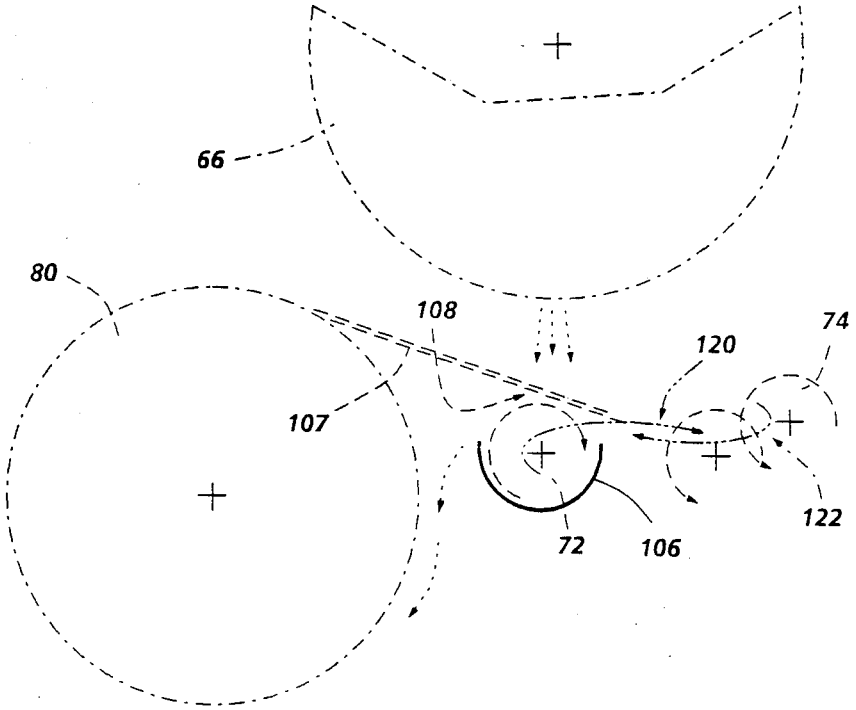
FIG. 5 is a side view schematic representation of the developer material transfer between the augers.

Turning now to a more detailed description of the developer station 24, and particularly the auger mixing assembly 70, FIGS. 2 and 3 show an end view and top view of the developer assembly. FIGS. 4 and 5 show the toner transfer betweens auger from a top and side view perspective, respectively. Auger 72 having arcuate segments 104 is mounted on horizontal shaft 100 which is driven by motor means (not shown) in a counterclockwise direction. Supported beneath auger 72 is a trough 106 extending the length of the auger. Supported above auger 72 is pickoff baffle 107 having a series of ports 108 extending therethrough permitting toner from housing 66 to be dispensed through the ports in a steady flow downward into the mixing assembly area sump 110 where it is then picked up by the exterior surface of sleeve 75 to form the toner brush 82. Auger 74, having arcuate segments 114, is mounted on inclined shaft 116 and driven by appropriate motor means in a clockwise direction. The configuration of shaft 116 is that the auger has an uphill end (FIG. 2 out of the page) and a downhill end (FIG. 2 into the page). Auger 74 is contained within a cylinder 118 enclosed except for toner transfer openings 120, 122 at both ends. As shown in FIGS. 4 and 5, the downhill end of auger 74 with transfer opening 120 is positioned adjacent one end of auger 72 and receives developer from the auger via gravity feed. The developer is transferred from auger 72 to auger 74 by gravitational force acting on the toner. Auger 74 then mixes the developer and carries it uphill. The developer then falls into sump 110 or is again picked up by auger 72 via opening 122 at the uphill end. In preferred embodiment for a 36 inch wide system, auger 72 is angled upward at an angle of approximately 1°.

A suitable controller 89 is provided for operating the various components of machine 8 in predetermined relation with one another to produce copies. In operation, machine 8 is actuated by a suitable start control button. The document to be copied is then inserted into the nip of document transport roll pair 55, 56 which carries the document across platen 50. As the leading edge of the document reaches a detector, controller 89, in response to the signal from the detector, starts feed roll pair 40 to advance the copy sheet 32 forward in timed relation with the document 9 as the document is transported across platen 50 and past scan point 52 by document transport 54. The document image developed on the photoconductive surface 16 of photoreceptor 14 is transferred to copy sheet 32 as the copy sheet moves through the transfer area. Following transfer, the copy sheet 32 passes to fusing station 48 where the image is fixed.

As latent images are formed, and developer and toner depleted, fresh toner is dispensed as dispenser cartridge 66 rotates. Auger 72 continually mixes the fresh toner with the denuded carrier particles and existing developer. As the auger 72 rotates in a counterclockwise direction, and with arcuate segments 104 having an orientation as shown, the mixture is conveyed from right to left in FIG. 4 and into the page in FIG. 5. The mixture then transfers into the auger 74 system, which carries the developer uphill to the retransfer point. The system is thus constantly ensuring that freshly added toner is constantly being mixed into the existing developer.

While the invention has been described with reference to the structure disclosed, it is not confined to the specific details set forth, but is intended to cover such modifications or changes as may come within the scope of the following claims.

What is claimed is:

1. In a development system including a developer roll adapted for depositing developer material on an imaging surface having an electrostatic latent image thereon, a dual auger system for mixing said developer material and transferring mixed developer to said developer roll, said dual auger system comprising a first auger aligned in a horizontal plane and adapted to mix and supply developer material to said developer roll, a second auger, adjacent to said first auger and positioned along a nonhorizontal plane so that adjacent ends of said first and second auger are separated by vertical distances, said augers having a plurality of toner transport communication apertures at said auger ends whereby toner is transported from one auger to the other by gravitational forces.

2. The development system of claim 1 further including an apertured trough-like member positioned beneath said first auger whereby toner is supplied through said apertures to the developer roll by gravity feed.

3. The development system of claim 1 wherein said second auger is enclosed within a cylinder having toner transport apertures at both ends.

4. The development system of claim 1 wherein said second auger is inclined in at an angle of approximately 1° with respect to the horizontal plane of said first auger.

5. The development system of claim 1, wherein said vertical distance includes a first vertical distance extending above the horizontal and a second vertical distance extending below the horizontal.

6. A dual auger magnetic brush development system wherein developer material is supplied to a rotating magnetic brush roll, the system comprising;

a first supply auger having a length at least as great as said magnetic brush roll, said first auger positioned along a horizontal plane and adapted to tranport developer material in a first direction so as to supply said material to said magnetic brush roll, a second crossmixing auger substantially the same length as said first auger and positioned at an angle with respect to said first auger so the one end is lower than the adjacent end of said first auger while the other end is higher than the respective other end of said first auger, said second auger rotating in a direction opposite said first auger, said auger having developer material transport apertures whereby developer material is tranported by gravity by said first auger end to the adjacent end of said second auger, the second auger transporting the developer material uphill to the opposite end where the toner is transferred by gravity feed to the opposite end of said first auger.

* * * * *